US005401897A

United States Patent [19]

Depalle et al.

[11] Patent Number: 5,401,897

[45] Date of Patent: Mar. 28, 1995

[54] SOUND SYNTHESIS PROCESS

[75] Inventors: Philippe Depalle, Paris, France; Xavier Rodet, Berkeley, Calif.

[73] Assignee: France Telecom, Paris Cedex, France

[21] Appl. No.: 30,101

[22] PCT Filed: Jul. 24, 1992

[86] PCT No.: PCT/FR92/00732

§ 371 Date: Mar. 18, 1993

§ 102(e) Date: Mar. 18, 1993

[87] PCT Pub. No.: WO93/03478

PCT Pub. Date: Feb. 18, 1993

[30] Foreign Application Priority Data

Jul. 26, 1991 [FR] France ..... 91 09502

[51] Int. Cl.[6] ..... G10H 1/057; G10H 1/08

[52] U.S. Cl. ..... 84/625; 84/627; 84/660; 84/663

[58] Field of Search ..... 84/603, 608, 659, 660, 84/663, 627, 693, 698, 622–625

[56] References Cited

U.S. PATENT DOCUMENTS

| | | | |
|---|---|---|---|
| 4,231,277 | 11/1980 | Wachi | 84/622 |
| 4,282,790 | 8/1981 | Wachi | 84/627 |
| 4,815,352 | 3/1989 | Tsukamoto et al. | 84/627 X |
| 4,909,118 | 3/1990 | Stevenson | 84/659 |
| 5,029,509 | 7/1991 | Serra et al. | 84/627 |
| 5,185,491 | 2/1993 | Izumisawa et al. | 84/663 |
| 5,196,639 | 3/1993 | Lee et al. | 84/603 |

FOREIGN PATENT DOCUMENTS 2087123 5/1982 United Kingdom .

*Primary Examiner*—Stanley J. Witkowski

*Attorney, Agent, or Firm*—Oblon, Spivak, McClelland, Maier & Neustadt

[57] ABSTRACT

A sound synthesis process. The invention relates to an additive sound synthesis process, as shown in FIGS. 1A and 1B, in which sample blocks (16) are determined by performing the inverse Fourier transform of successive frequency spectra. The time-superimposed sample blocks (16) are added in order to form a sequence of samples representing the reconstituted sound wave.

20 Claims, 5 Drawing Sheets

SOUND SYNTHESIS PROCESS

BACKGROUND OF THE INVENTION

1. Field of the Invention

The present invention relates to an additive sound synthesis process and is more particularly applicable to the creation of musical sounds.

2. Related Art

Additive synthesis normally takes place by a bank of sinusoidal oscillators and processing means making it possible to obtain a sampling of the sinusoids used for obtaining a discretized representation of the musical wave. As a result of the large number of samples necessary for this representation, they are produced by a computer. The calculated samples contained in a memory are converted into a voltage during a digital/analog conversion operation. The sequence of discrete pulses is smoothed by filtering in order to obtain a continuous electric signal, which is amplified and then supplied to a transducer in order to be audible.

It is known that additive sound synthesis identifies the sound phenomenon on superimposing sinusoidal components, whose characteristics can be estimated by a Fourier analysis. The main wave is broken down into a series of frequency components. When the sound is harmonic, the frequency components have multiple frequencies of a so-called fundamental frequency, which corresponds to the pitch and the amplitudes of the components determine the timbre of the sound.

In additive synthesis, the digital signal S(n) representing the synthesized sound is equal to the sum of the j sinusoidal components Cj of frequencies, amplitudes and sometimes phases, which are variable over a period of time:

$$S(n) = \sum_{j=1}^{J} C_j(n)$$

with $$C_j(n) = a_j(n)\mathrm{Cos}\,[2\pi f_j(n)n/Fe + \alpha_j(n)]$$

For the component Cj, with a sample n:

fj(n) is the frequency, aj(n) is the amplitude,

αj(n) is the phase term,

Fe is the sampling frequency.

In known manner, the values of the parameters of the frequencies, amplitudes and phases necessary for the calculation of the signal S(n) during time are supplied to the computer at a so-called refreshing frequency generally below 200 Hz relating to the time constant of the ear.

These parameters can come from an analysis of a sound, an algorithm modelling a certain type of sound (synthesis of an instrument e.g. by the construction of its spectrum) or in pure synthesis data from a musician relating to the frequencies which he wishes to be heard.

As the signal must be generated at a higher sampling frequency than the refreshing frequency of the sets of parameters, there is an interpolation between two successive parameter sets surrounding the instant corresponding to the calculated sample. In practice, the sampling frequency is either 44.1 KHz or 48 KHz, whereas the refreshing frequency is below 200 Hz.

It is necessary to avoid the generation of a succession of sudden variations of values, which would lead to noises or clicks occurring at the refreshing frequency of the parameters.

For each component and starting with the frequency fj(n), an instantaneous phase is calculated:

$$\phi_j(n) = \left[\phi_j(n-1) + \frac{2\pi}{Fe} f_j(n) + \phi_j(n) - \phi_j(n-1)\right]$$

modulo $2\pi$ which makes it possible to calculate the sinusoidal component. The latter is obtained by addressing a table containing the sampled value of Sin x for x assuming M values between 0 and 2 (e.g. M=4096). The value obtained is multiplied by the instantaneous amplitude aj(n) in order to give Cj(n). The values of j components calculated in this way are summated in order to produce the sample S(n).

These stages are repeated for calculating each of the successive samples.

This additive synthesis procedure has a disadvantage of requiring a significant calculation time. Thus, for a given computer, the number of components which can be calculated in real time is low, namely from 8 to 13 on a microprocessor DSP 56000 manufactured by Motorola. Reference can be made in this connection to the article by John Strawn "Implementing Table Look-up Oscillators for Music with the Motorola DSP 5000 Family", Proc. 85th AES Convention, November 88, LA, USA.

The difficulty of producing noise with a random spectral density constitutes another disadvantage of this process. However, the presence of noise is fundamental to the creation of musical sounds. Thus, it makes it possible to credibly simulate wind instruments by the reproduction of breathing and other transients.

Instead of working in a time range as described hereinbefore, another procedure consists of working in the frequency range. Reference should be made in this connection to ICASSP, 1988 entitled "FFT Multi-Frequency Synthesizer", New York, pp. 1431–1434, by Tabei et al.

However, this document only refers to the reconstruction of a signal window. This solution suffers from the disadvantage of adding noise to the signal and also of being incomplete. Thus, it is only possible to reconstruct a signal when the parameters evolve in a complex manner with such a method. This method consisting of synthesizing the signal from a single window is unsuitable for most musical signals (the parameters e.g. evolve when there is a note held with vibrato).

SUMMARY OF THE INVENTION

The present invention makes it possible to obviate the disadvantages of the known procedures. The recommended additive sound synthesis process uses a frequency-type method enabling the Expert to carry out a sound synthesis having the same flexibility of use as a time procedure, without suffering from the disadvantages thereof and without suffering from the disadvantages of the frequency procedure referred to hereinbefore.

Thus, the calculating times are considerably reduced, so that for standard processors (e.g. the Motorola 68000) there is an efficiency ratio of approximately 13 for a large number of sinusoids (>1000 sinusolds).

The invention relates to a additive sound synthesis process in which determination takes place of sample blocks by carrying out the inverse Fourier transform of successive frequency spectra. The time-superimposed sample blocks are added to form a sequence of samples representing the sound wave.

The present invention more specifically relates to a process for the synthesis of sounds, characterized in that it consists of:

A) generating a synthesis signal by superimposing/adding time-displaced signal blocks, each block being obtained by an inverse Fourier transform operation of a constructed frequency spectrum, B) constructing said spectrum by carrying out the following stages:

choosing a spectral envelope, then iteratively and for each desired frequency component:

multiplying the spectral envelope by the amplitude of the component weighted by its phase factor, so as to obtain a pattern representing said frequency component, adding the pattern obtained to the spectrum being constructed, C) adding to the spectrum obtained the spectrum corresponding to the unwanted part of the signal to be synthesized.

Thus, successive sample blocks are calculated by means of a fast inverse Fourier transform ($FFT^{-1}$). The superimposing of successive blocks, each displaced with respect to the preceding block, reconstitutes the signal representing the sound wave. The superimposing in particular ensures a good quality of the reconstituted signal avoiding calculation errors at the boundaries of the block.

According to a feature of the process according to the invention, there is a linear interpolation of the amplitudes of the components without any distortion between individual signal blocks.

According to another feature of the process, the distortions due to the evolution of the frequencies and phases are minimized by choosing the optimum point No. for the connection of the instantaneous phase:

$$2\pi fj(Te)+\alpha j$$

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

According to the process of the invention, a set of parameters Cj (frequencies fi, amplitudes Ai, phases $\alpha i$, unwanted components Bi) is supplied to a not shown computer for the determination of the digital samples representing the sound wave at a refreshing frequency of e.g. 200 Hz.

These parameters come either from the mechanical action of an instrumentalist, e.g. on a keyboard and which is then converted into electric data signals, or the modelling of a musical instrument, or any means making it possible to obtain these input parameters.

Figure 1A:
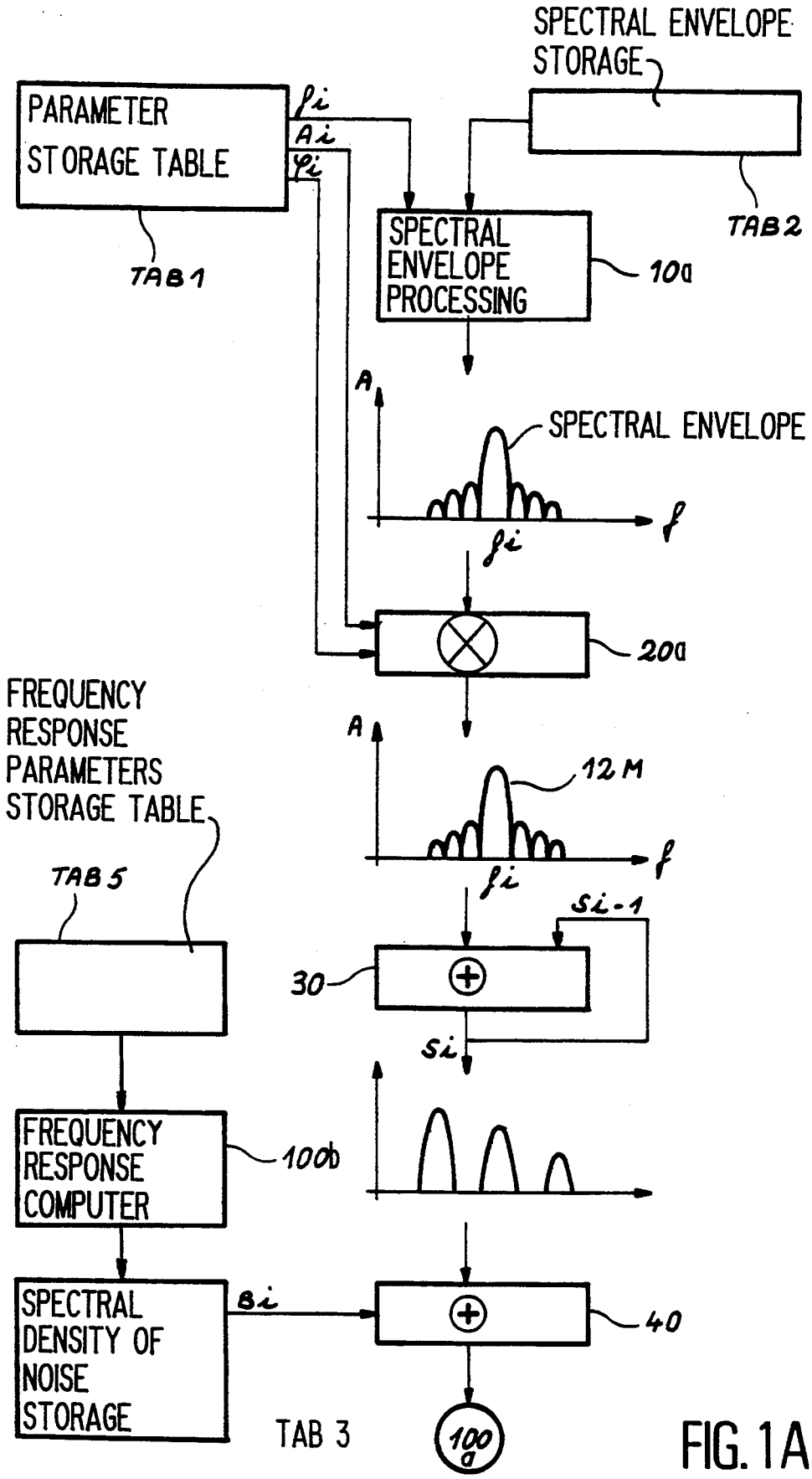
FIGS. 1A and 1B show a mimic diagram of the different stages of the process according to the invention.
Figure 1B:
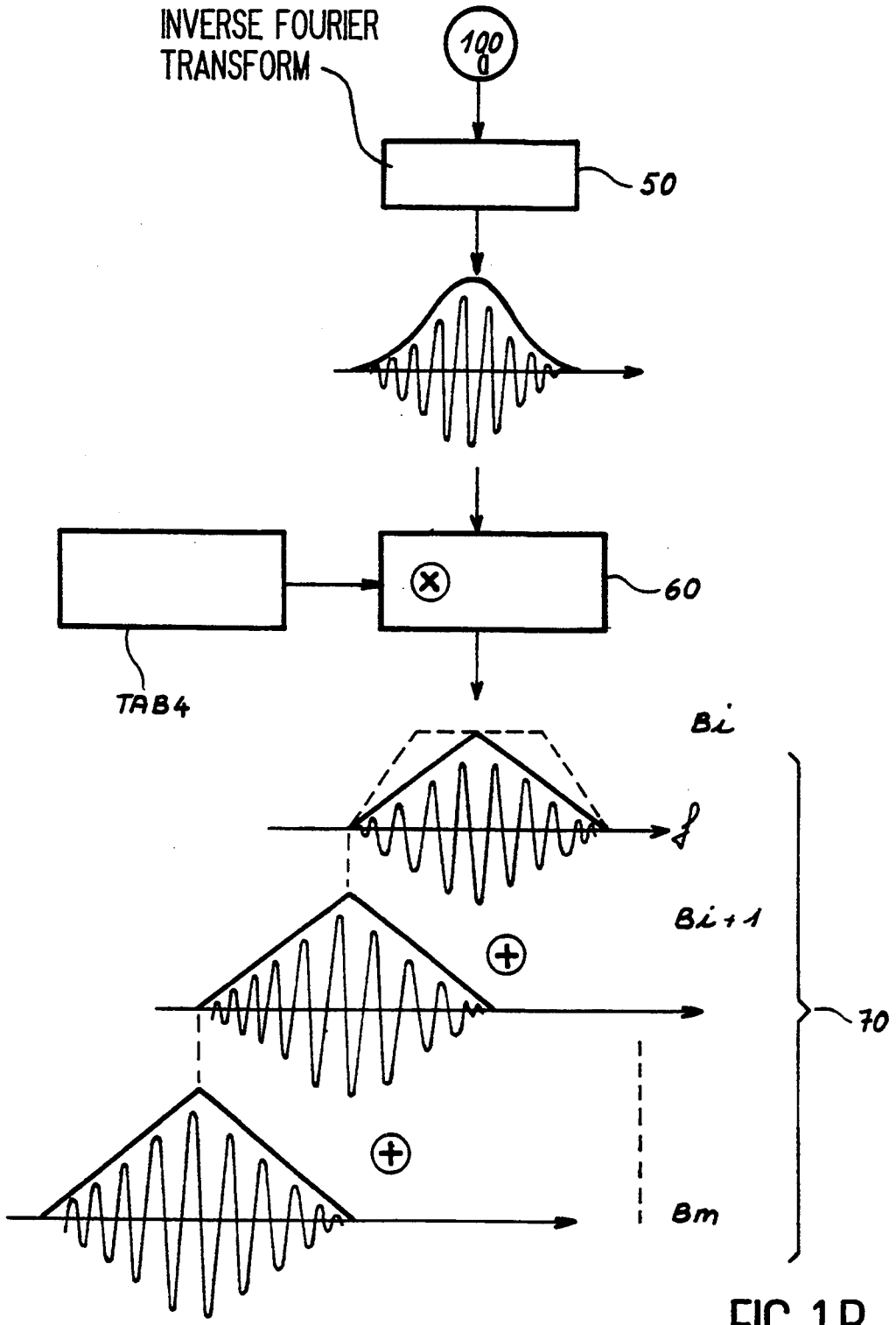

Reference should now be made to the mimic diagram of FIGS. 1A and 1B in order to provide a better understanding of the different stages of the process according to the invention. These stages will be described hereinafter in connection with FIGS. 3 to 6.

In preferred manner, the parameters Cj (fi, Ai, $\alpha i$) are recorded in a storage table TAB1. The chosen spectral envelope is also recorded in a table TAB2. The spectral density of the noise to be introduced into the synthesis signal is also recorded in a table TAB3.

The process consists of generating a synthesis signal S by superimposing/adding blocks Bi, Bi+1 Bm of time-displaced signals (stage 70, FIG. 1B). Each block is obtained by an inverse Fourier transform operation (stage 50, FIG. 1B) of a constructed frequency spectrum.

The production of the spectrum consists of carrying out the following stages in iterative manner for each desired frequency component:

multiplying the spectral envelope by the amplitude Ai of the component weighted by its phase factor $e^{j\,i}$ (reference 20a, FIG. 1A) and in this way a pattern is obtained represented by the curve 12M in FIG. 1A and which is a representation of the frequency component, adding the pattern obtained to the spectrum Si-1 being constructed in order to obtain Si (reference 30, FIG. 1A), adding to the spectrum obtained the spectrum corresponding to the unwanted part of the signal (reference 40, FIG. 1A).

The spectrum corresponding to the unwanted part of the signal is obtained by multiplying the spectral density of a white noise by the frequency response of a filter.

For this purpose there is a white noise generator and a frequency response computer 1006. This computer 1006 uses the frequency response parameters tabulated in the storage table TAB5 (FIG. 1A).

To avoid the convolution of the frequency response by the spectral envelope, preference is given to a convolution between the spectrum of the white noise and the spectral envelope chosen for the signal, followed by the tabulation of the results obtained. Thus, as shown in FIG. 1A, the results Bi of the convolution are directly available in a storage table TAB3.

In addition, the spectral envelope is tabulated in the table TAB2 in an oversampled form in order to have a finer frequency resolution than made possible by the size of the spectrum to be constructed compared with the sampling of the blocks.

Stage 10a (FIG. 1A) consists of sampling the undersampled form corresponding to the precise value of the frequency corresponding to the value fi and placing it in the spectrum to be constructed and which is centered on the spectral component closest to fi.

Figure 2:
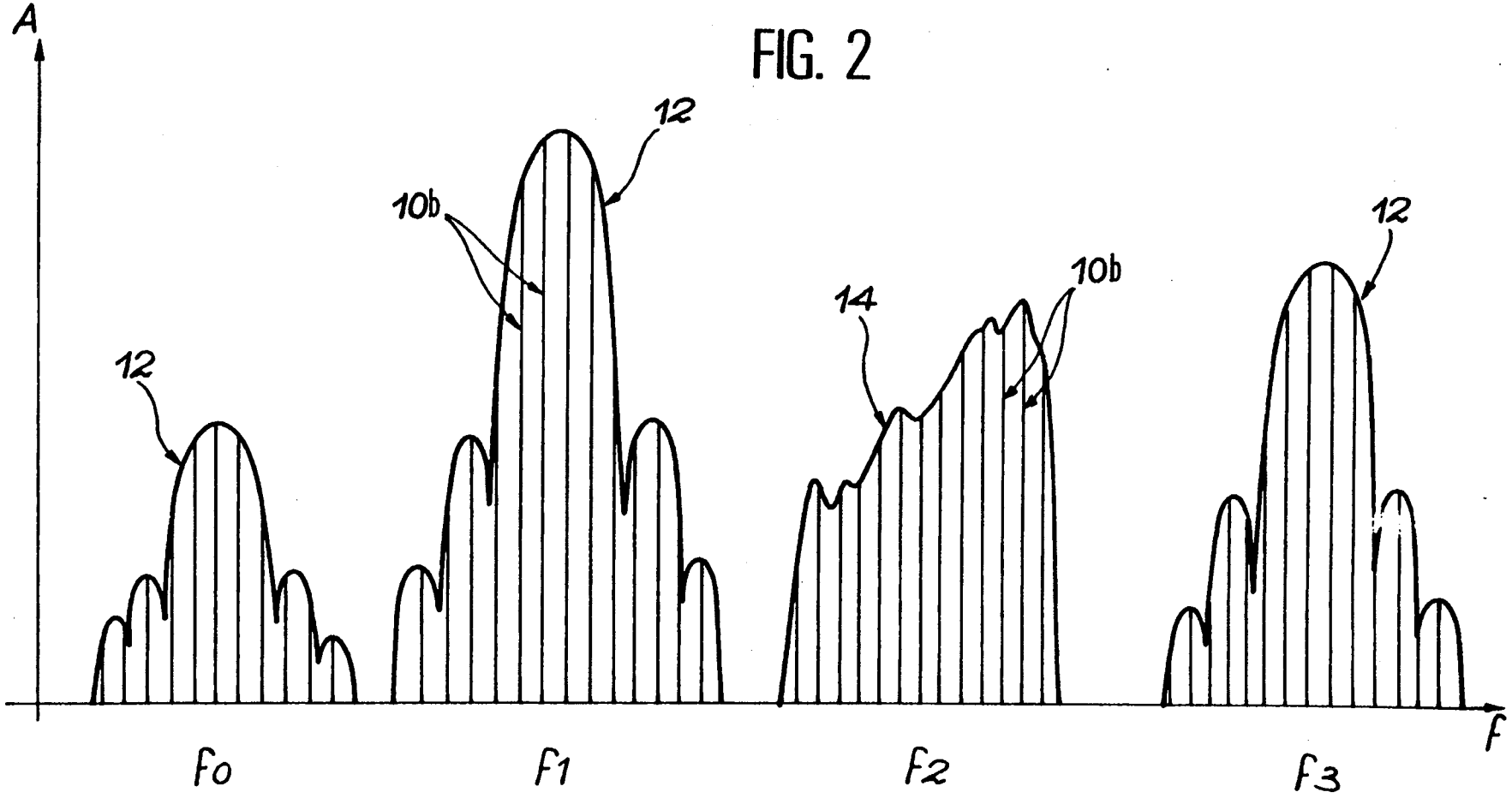
FIG. 2 diagrammatically shows a partial view of a frequency spectrum.

The process according to the invention will now be described in greater detail. The parameters of each set make it possible to construct a frequency spectrum like that partly shown in FIG. 2.

Each frequency spectrum is obtained by adding discrete spectral components 103 grouped in spectral envelopes 12, 14. Each spectral envelope corresponds to a sinusoidal component 12 or a spectral noise band 14.

An envelope corresponding to a sinusoidal component groups one to ten spectral components. An envelope corresponding to an unwanted component groups a number of spectral components proportional to the width of the noise band. These envelopes can be superimposed and then the corresponding spectral components are added to one another. The spectral envelopes are of two types, those designated 12 corresponding to sinusoidal components and those designated 14 to unwanted components. These spectral envelopes 12, 14 are limited time base function Fourier transforms.

Advantageously, in the case of spectral envelopes 12 corresponding to sinusoidal components, the envelopes 12 will be chosen such that they only assume a non-negligible value in the narrow frequency band contained in the range defined by $-Fe/2$ and $+Fe/2$, in which Fe is the sampling frequency. For example, it can be considered that the envelope is negligible when it is below 40 or 60 dB at its maximum, said values not being limitative.

The time functions corresponding to this definition of spectral envelopes in the frequency range are numerous. They are of the "window" type. Reference can be made in non-limitative manner to the Hann window or the Blackmann window, referred to in generic form as fen(n) in the remainder of the description.

A large number of time functions or windows which can be used are referred to in the article by Harris J. "On the Use of Windows for Harmonic Analysis with the Discrete Fourier Transform", Proc. of the IEEE, Vol. 66, No. 1, January 1978, pp. 51–83.

On e.g. choosing the Hann window, it is possible to consider his Fourier transform as non-negligible for only 7 to 14 points. The Hann time window ha of length 2T is defined as follows:

$$\begin{aligned} ha(n) &= 1/2 \operatorname{Cos}[2\pi(n/2T)] \text{ for } -T \leqq n < +T \\ &= 0 \text{ outside this interval,} \end{aligned}$$

T being the time parameter and n the number of the sample to be constructed.

The Hann Fourier transform ha is used as the envelope 12 for constructing the frequency spectrum, which is centered on the frequencies f0, f1, f3, etc., defined by the input parameters. Each envelope has an amplitude which is also defined by these parameters. The centre frequencies f0, f1, f3, etc., are optionally accompanied by phases defined datawise by the input parameters.

In order to improve the sample determination performance speed, the Fourier transform of the window function is calculated once and for all, tabulated and recorded in the computer memory, as stated hereinbefore.

The envelopes 14 correspond to a noise spectrum, which is also tabulated and recorded in the computer memory. A frequency spectrum has the same number of envelopes as components in the sound, e.g. ranging from 1 for a pure sound to several hundred for rich sounds, said values not being limitative.

The frequency spectrum is only calculated by the above method for positive frequencies and is completed by symmetry for negative frequencies. For each positive frequency term is added a negative frequency term, which is the conjugate complex of the positive frequency term. In this way a sequence of sample blocks is determined, each forming a representation of the sound wave for a duration 2T, the time length of the chosen window function.

Once a frequency spectrum has been formed, the discrete inverse Fourier transform is carried out by means of a split-radix $FFT^{-1}$ algorithm, or any other fast Fourier transform algorithm type.

Figure 3:
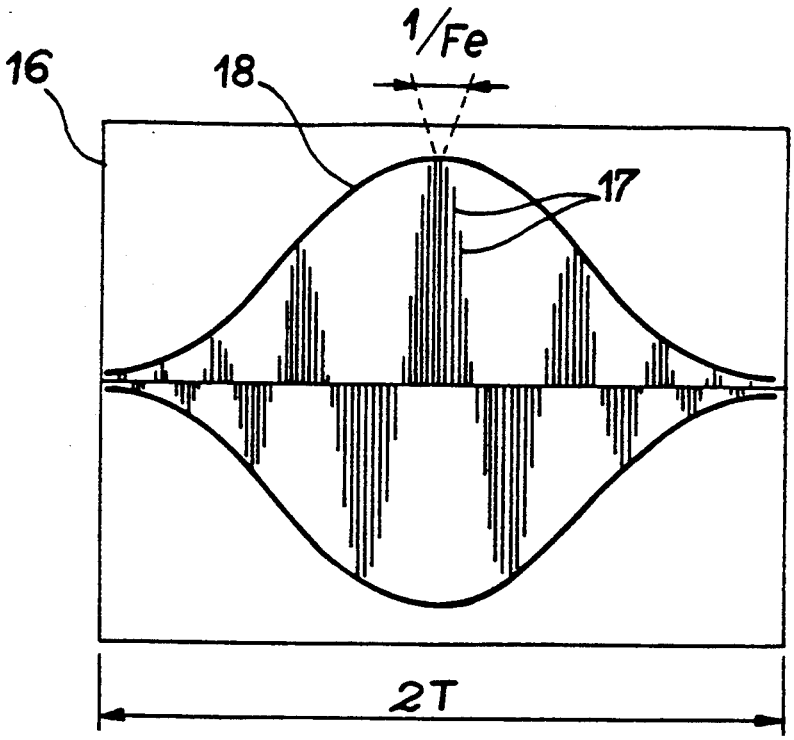
FIG. 3 diagrammatically shows a sample block calculated from a frequency spectrum.

FIG. 3, representzing a sample block, makes it clear that the sample sequence 17 of the block 16 is contained in an envelope 18, which is in this case the Hann window function ha(n). The time 2T is e.g. equal to approximately 2.67 ms.

The samples 17 are separated by a period Te equal to the inverse of the sampling frequency Fe. The latter is e.g. 48000 Hz (48000 samples reconstitute is of the sound wave, Te being equal to 20.83 microseconds). Thus, a sample block e.g. comprises 128 samples.

The inverse Fourier transform of the frequency spectrum consequently makes it possible to obtain a sampling sequence, which is mathematically expressed by the operation s(n+mT).fen(n), in which fen(n) is the chosen time window function and is equal to the inverse Fourier transform of the spectral envelope used for constructing the spectrum. In this expression, n is the sample number in the block, 2T the size of the considered block, m the number of the block and n+mT the absolute number of the sample.

In order to obtain the sequence of samples corresponding to the sound representation, the parts of successive sample blocks which overlap are added, these being obtained by inverse Fourier transforms of successive frequency spectra.

Prior to the addition of the parts of the blocks which overlap, discontinuities appearing between two successive blocks are smoothed. For this purpose, each block is multiplied by a smoothing function, which is the ratio of a dividend function called div by the function fen(n). The function div is such that, displaced by a certain number of samples and added to itself, it gives a constant value on the overlap interval.

Figure 4:
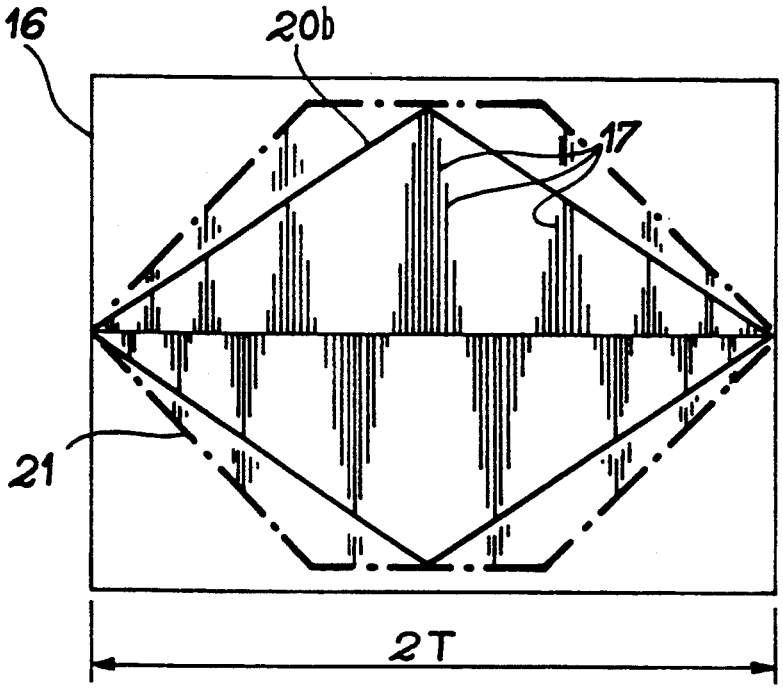
FIG. 4 diagrammatically shows a sample block multiplied by a smoothing function.

Preferably, the dividend function div is the triangular function tr(n) carrying the reference **20*b* in FIG. 4**. Such a triangular function tr(n) of length 2T is defined by the relations:

$$\begin{cases} tr(n) = 1 + n/T \text{ for } -T \leqq n \leqq 0 \\ tr(n) = 1 - n/T \text{ for } 0 < n \leqq t \end{cases}$$

The following operation is performed:

$$\underbrace{s(n + mT) \cdot fen(n)}_{①} \cdot \underbrace{tr(n)/fen(n)}_{②}$$

in which the first expression ① is the calculation of the inverse Fourier transform and in which the second expression ② is tabulated (TAB4).

As the dividend function can also be used the trapezoidal function 21, which can also be seen in FIG. 4. Preferably, the dividend function is symmetrical, the triangular and trapezoidal functions **20*b*, 21** being isosceles.

In the example described it has been seen that a sample block lasts approximately 2.67 ms, whereas the input parameters are e.g. supplied at a frequency of 200 Hz, i.e. every 5 ms.

In order to be able to add the successive sample blocks and completely reconstitute a sound wave in real time, it is necessary for the time succession of the frequency spectra to be such that the successive sample blocks are superimposed. For this purpose, supplementary frequency spectra are formed by means of an interpolation of the input parameters.

Figure 5:
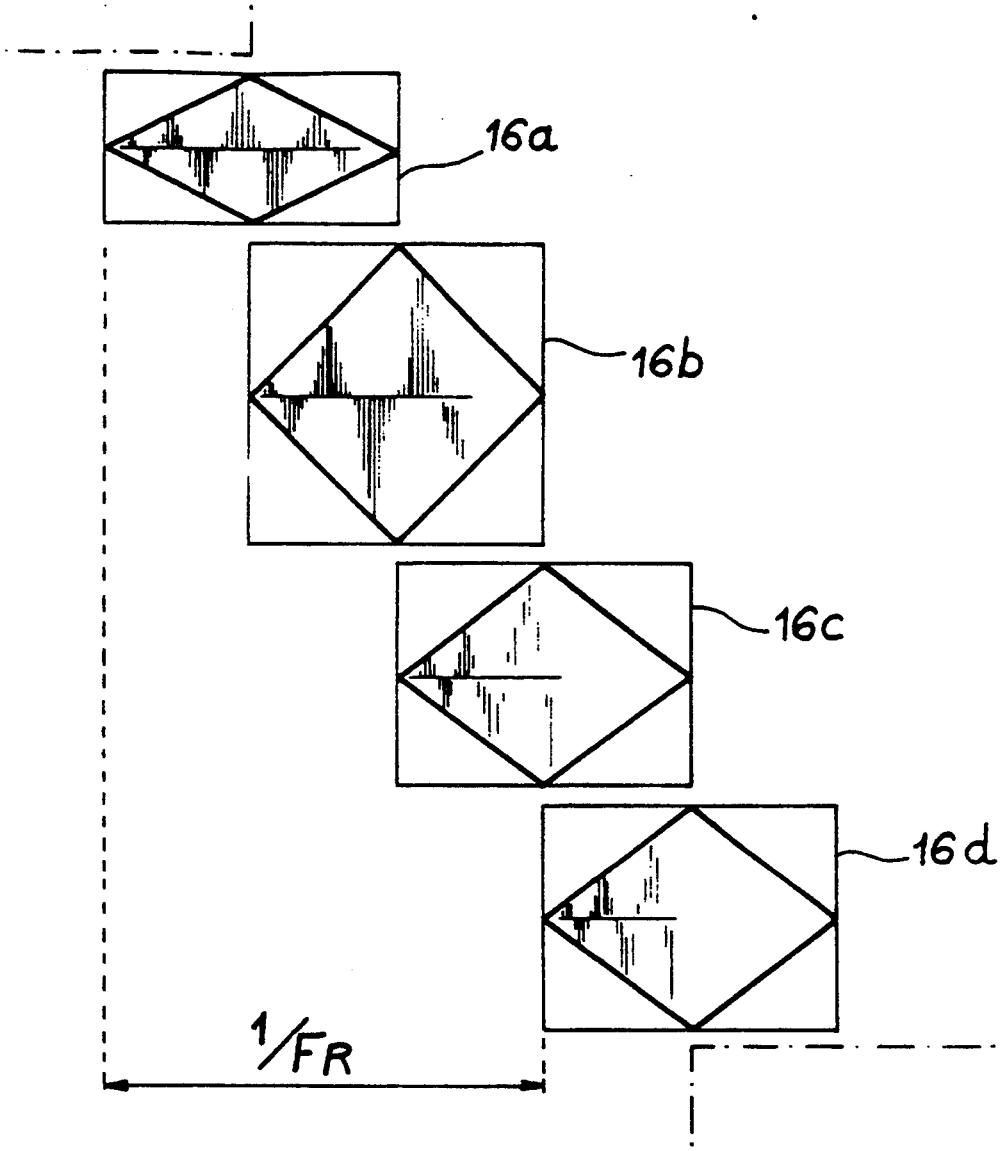
FIG. 5 diagrammatically shows the superimposing of a sequence of sample blocks.

FIG. 5 shows the superimposing of four sample blocks 16*a*, 16*b*, 16*c*, 16*d*. The blocks 16*a* and 16*d* are determined on the basis of frequency, amplitude and phase data and are separated by a duration 1/FR, which is the inverse of the refreshing frequency. The blocks 16*b* and 16*d* are due to frequency spectra formed as a result of parameters interpolated on the basis of the input parameters. There is no need for the refreshing period 1/FR to be a multiple of T.

FIG. 5 shows that in this example the decreasing part of the triangular envelope of a sequence of samples is superimposed on the increasing part of the triangular envelope of the following sample sequence. In other words, in this case the blocks are half-superimposed, but any other proportion can be used.

For every n in the range [(m−1)T, mT−1], a sample is equal to:

$$s(n)=s(n)tr(n-(m-1)T)+s(n)tr(n-mT)$$

i.e. to the sum of the right-hand half of block number m−1 and the left-hand half of block number m, so that we obtain:

$$\begin{aligned} tr(n-(m-1)T)+tr(n-mT) &= 1-(n-m-1)T)/T+1+(n-mT)/T \\ &= 1 \end{aligned}$$

If it is considered that among the frequencies and phases making it possible to form frequency spectra some vary on passing from a block of number m to the following block of number m+1, which can be written:

$$fj,mT \neq fj,(m+1)T$$

$$\alpha j,mT \neq \alpha j,(m+1)T$$

whereas conditions at the limits must be respected in connection with the instantaneous phase of the corresponding time signals.

In the case where the amplitudes of each pair of spectral components are constant on passing from a block n between the times (m−1)T and (m+1)T to the following block, which is written in the form aj,mT=aj,(m+1)T, the signal constituted by the samples of the first block must be in phase with the signal constituted by the samples of the second at instant (m+½)T.

In the case where the amplitudes are not equal during the passage between the blocks and which is written aj,mT≠aj, (m+1)T, the instantaneous phases (2πfjFe+αj) must be equal at the point No, where the amplitudes of the envelopes of the signals constituted by the samples are equal.

Figure 6:
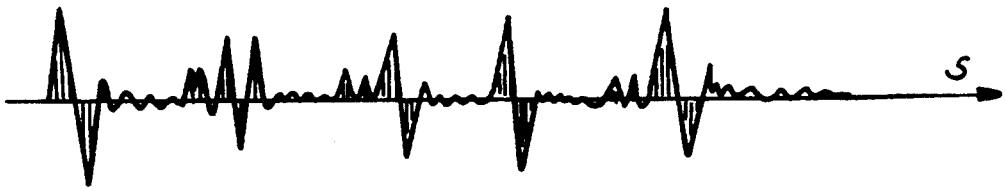
FIG. 6 diagrammatically a sequence of samples following the addition of the sample blocks.

With these phase conditions respected, the addition of successive blocks forms a sampling sequence like that partly shown in FIG. 6.

During real time, this sampling sequence represents the sound wave. The values of these samples can undergo all conventional filtering, smoothing, digital-/analog conversion and amplification operations for forming a continuous electric signal supplied to a transducer for being audible.

The additive synthesis by $FFT^{-1}$ and addition-superimposing of the different blocks according to the invention can be performed by a microprocessor. Use can e.g. be made of microprocessor DSP 56000 marketed by Motorola.

In an embodiment, one or two of these microprocessors can be coupled to a keyboard for supplying a polyphony of more than six voices of random timbres having several hundred parts.

We claim:

1. Process for the synthesis of sounds, the steps comprising:

A) generating a synthesis signal by superimposing time-displaced signal blocks, which are overlapped in time, each block being obtained by an inverse orthogonal transform of a constructed frequency spectrum, B) constructing said spectrum by carrying out the following steps:

choosing a spectral envelope, then interactively and for each desired sinusoidal, discrete spectral frequency component, defined by its frequency, amplitude and phase parameters:

multiplying the spectral envelope by the amplitude of the component weighted by its phase factor, which is computed such that the phases of a given said sinusoidal component in overlapping blocks are equal at a point where the amplitudes of the envelopes of this sinusoidal component in the two overlapping blocks are equal, so as to obtain a pattern representing said frequency component, adding the so obtained pattern to the spectrum being constructed, C) adding the spectrum corresponding to the unwanted part of the signal to be synthesized to the spectrum obtained in Step B.

2. Process according to claim 1, wherein prior to the addition stage, each block constituted by samples is multiplied by a smoothing function so as to smooth the discontinuities appearing between successive sample blocks.

3. Process according to claim 1 wherein the step of choosing a spectral envelope, further comprises:

choosing a spectral envelope according to a grouping of the spectral components in one of the signal blocks, the spectral envelope is an orthogonal transform of a limited time base function.

4. Process according to claim 2, wherein the smoothing function is the ratio of a dividend function (div) by the limited time base function (fen), the dividend function being such that, displaced by a certain number of samples and added to itself, it gives a constant value on an interval between said overlapping blocks.

5. Process according to claim 4, wherein the dividend function is symmetrical.

6. Process according to claim 4, wherein the dividend function is a triangular function (20).

7. Process according to claim 4, wherein the dividend function is a trapezoidal function (21).

8. Process according to claim 3, wherein said envelopes only assume a non-negligible value in a frequency band centered on a positive frequency and contained in a range limited by $-Fe/2$ and $+Fe/2$, in which Fe is the sampling frequency.

9. Process according to claim 8, wherein the envelopes are made as narrow as possible.

10. Process according to claim 8, wherein, during building of frequency spectra, the discrete spectral components, grouped under said envelopes corresponding to a noise spectrum, are added to the frequency spectra being built.

11. Process according to claim 1, wherein: the frequency and amplitude are interpolated.

12. Process according to claim 1, characterized in that the spectrum corresponding to a part of the signal considered non-sinusoidal is obtained by the multiplication of the spectral density of a white noise by a frequency response of a filter.

13. Process according to claim 12, characterized in that before multiplying the spectral density of the white noise by the frequency response of said filter, a convolution is performed between the spectrum of the white noise and the chosen spectral envelope and in that the convolution results are recorded in a storage table.

14. Process according to claim 1, characterized in that the chosen spectral envelope is oversampled compared with the sampling of the blocks and is recorded under its oversampled version in a storage table.

15. Process according to claim 1, characterized in that, in a preliminary state, parameters of the components of the spectrum are recorded in a storage table.

16. A process for the synthesis of sounds from a sound signal corresponding to a sample block (Cj) digitally stored as discrete components including frequencies (fi), amplitudes (Ai), phases ($\rho$i) and noise components (Bi), i being the number of discrete components, the steps comprising:

selecting a type of frequency domain spectral envelope based on shape, said spectral envelope being of the window-type;

sampling said spectral envelope at said frequencies (fi) to create a sampled spectral envelope;

multiplying said sampled spectral envelope at each of the frequency points (fi) with a corresponding said amplitude (Ai) and phase ($\rho$i) over a range of frequencies (fi) to obtain a pattern;

adding said pattern with the spectrum being constructed to obtain an auto-correlated spectrum;

adding said noise components (Bi) with said auto-correlated spectrum to obtain a frequency domain block;

obtaining an inverse Fourier transform of the frequency domain block to obtain a time-displaced signal block;

repeating said process for the synthesis of sounds for other sample blocks and obtaining a plurality of time displaced signal blocks, which overlap in time; and superimposing said time displaced signal blocks in real time to synthesize sounds.

17. The process according to claim 16, wherein said step of selecting a spectral envelope further comprises the step of:

choosing spectral envelopes which ignore negligible sinusoidal components below 40 dB.

18. The process according to claim 16, wherein the spectral envelopes are selected from a group consisting of a Hann window and a Blackmann window.

19. The process according to claim 16, wherein the step of multiplying further comprises the step of:

storing said discrete components of said sample block (Cj) which correspond only to positive frequencies; and completing said pattern for negative frequencies using symmetry.

20. The process according to claim 16, further comprising the step of:

multiplying each said sample block in time domain with a smoothing function to smooth discontinuities appearing in overlapping said sample blocks.

* * * * *